US006616501B2

(12) United States Patent
Spalinski

(10) Patent No.: US 6,616,501 B2
(45) Date of Patent: Sep. 9, 2003

(54) TRIM ADJUSTMENT FEATURE FOR TOY VEHICLES

(75) Inventor: Robert P. Spalinski, Titusville, NJ (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 10/164,784

(22) Filed: Jun. 7, 2002

(65) Prior Publication Data

US 2003/0082992 A1 May 1, 2003

Related U.S. Application Data

(60) Provisional application No. 60/336,401, filed on Oct. 29, 2001.

(51) Int. Cl.[7] ..... A63H 11/00; A63H 15/00

(52) U.S. Cl. ..... 446/279; 446/396; 446/470

(58) Field of Search ..... 446/440, 454, 446/457, 462, 465, 470, 396, 279, 275, 280, 286, 290

(56) References Cited

U.S. PATENT DOCUMENTS 796,893 A * 8/1905 Brennan ..... 180/219
3,574,969 A * 4/1971 Cleveland et al. ..... 446/275
4,767,376 A * 8/1988 Hanzawa ..... 446/457
6,095,891 A 8/2000 Hoeting et al.
6,170,354 B1 1/2001 Lee
6,315,630 B1 11/2001 Yamasaki

* cited by examiner

*Primary Examiner*—Jacob K. Ackun
(74) *Attorney, Agent, or Firm*—Akin, Gump, Strauss, Hauer & Feld, L.L.P.

(57) ABSTRACT

The present invention is a trim adjustment mechanism to balance a toy vehicle. One vehicle has a platform supporting two wheels in line along a central longitudinal vertical plane through the platform. The trim adjustment mechanism has a weight holder slideably supported by the platform to move transversely to the central vertical plane. A weight member is engaged with the weight holder for slideable movement with the weight holder. An adjustment lever has a first end operably coupled with the weight holder. The adjustment lever is pivotable about the first end such that rotation of the adjustment lever causes sliding side-to-side movement of the weight member, whereby a user can effectuate side-to-side movement of the weight member within the vehicle with the adjustment lever in order to balance the vehicle and enhance the stability of the vehicle.

16 Claims, 4 Drawing Sheets

TRIM ADJUSTMENT FEATURE FOR TOY VEHICLES

CROSS-REFERENCE TO RELATED APPLICATIONS

This application claims the benefit of U.S. Provisional Application No. 60/336,401 filed on Oct. 29, 2001.

BACKGROUND OF THE INVENTION

This invention generally relates to remote-controlled toys, and more particularly to remote-controlled toy vehicles which must balance to operate such as two-wheeled scooters.

Two-wheeled wireless controlled toys are generally known. It is also generally known that as two-wheeled toy vehicles are made smaller, the balance of the components within the toy becomes more critical for steering performance. It has been found that weight imbalances between the right and left sides can cause the two-wheeled toy to drift to the heavier side when it is intended that the vehicle go straight. This problem is accentuated in smaller toys because weight imbalances have a greater relative effect due to the lesser overall weight and because smaller and lighter stabilizing means necessitated by the smaller size of smaller vehicles are less effective and because size constraints for certain components, e.g. motors and batteries, make the attainment of static balance difficult. It would be advantageous to counteract weight imbalances in two-wheeled toy vehicles to eliminate the toys from undesired drifting. The adjustable trim feature for a two-wheeled toy vehicle in the invention performs this function.

BRIEF SUMMARY OF THE INVENTION

Briefly stated, in one aspect, the present invention is a wheeled toy vehicle configured to be maneuvered on a surface. The vehicle comprises a platform having a front end and a back end. A first wheel is rotatably supported from the platform proximal the front end. A second wheel is rotatably supported from the platform proximal the back end. The first wheel and the second wheel are generally in line along a center vertical plane of the platform and parallel to each other and to the center vertical plane. A trim adjustment mechanism is mounted to the platform so as to adjust side-to-side to balance the vehicle and thereby enhance the stability of the vehicle.

In another aspect, the invention is a trim adjustment mechanism in a toy vehicle configured for movement in at least a forward direction and including a chassis and a central longitudinal vertical plane through the chassis, the trim adjustment mechanism balancing the vehicle, the trim mechanism comprising: a weight member mounted for movement in the vehicle to either side of the center longitudinal vertical plane; and an adjustment lever having a first end operably coupled with the weight member so as to enable manual movement of the weight member to either side of the center longitudinal vertical plane; whereby a user can effectuate side-to-side-movement of the weight member within the vehicle with the adjustment lever in order to balance the vehicle to enhance stability of the vehicle at least during forward movement.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
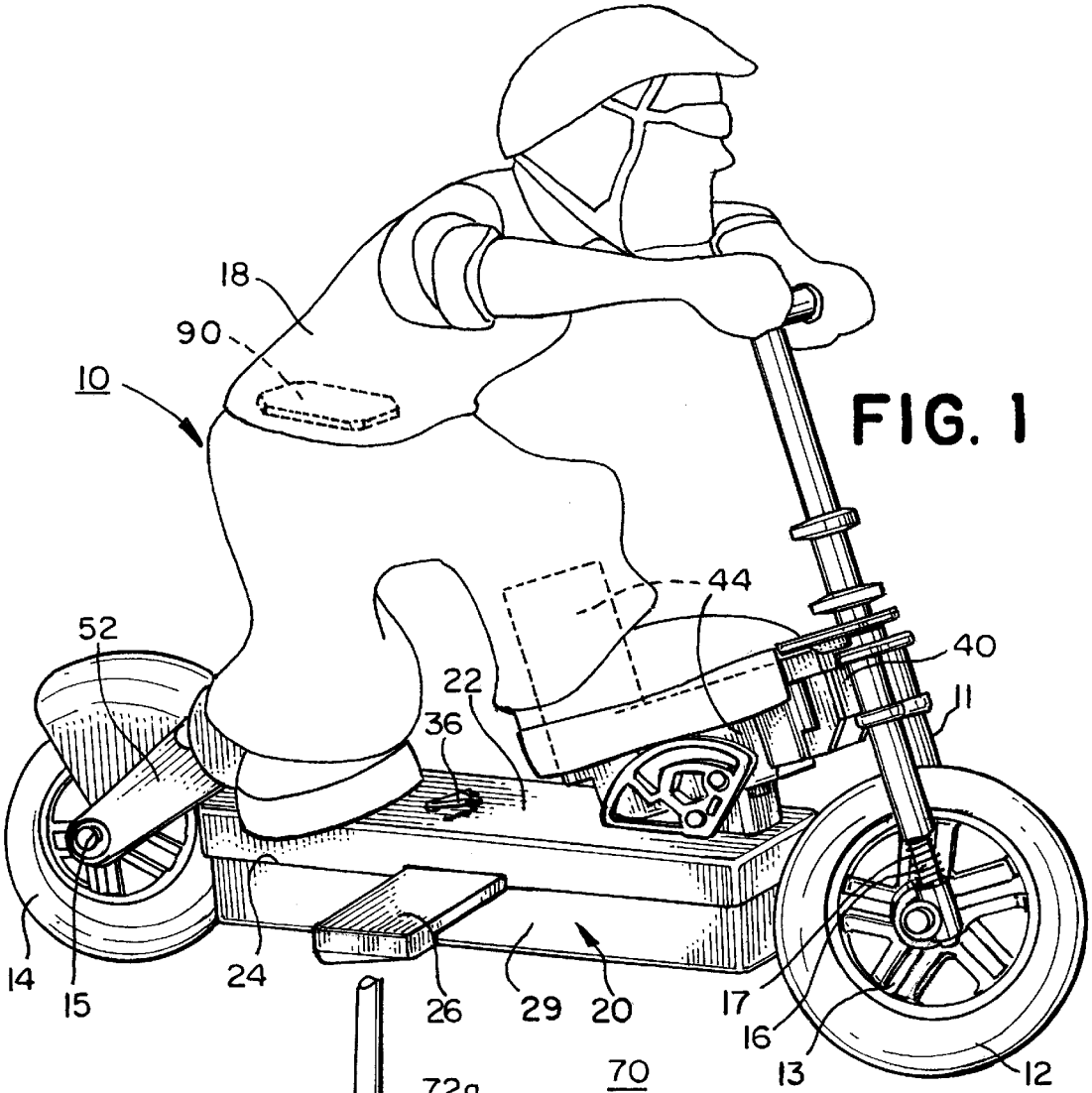
FIG. 1 is a view as seen from the right front side of a two-wheeled scooter toy vehicle within which the present invention would be used.

Certain terminology is used in the following description for convenience only and is not limiting. The words "right", "left", "upper" and "lower" designate directions in the drawings to which reference is made. The terminology includes the words above specifically mentioned, derivatives thereof, and words of similar import.

A wheeled toy vehicle, indicated generally at 10, embodying the preferred embodiment of the invention as shown in FIG. 1. The vehicle 10 is configured to be maneuvered on a surface (not shown). The vehicle 10 includes a chassis in the form of a scooter deck or a platform 20 with front and back ends, a first/front wheel 12, a second/rear wheel 14, and a trim adjustment mechanism 30.

Figure 5:
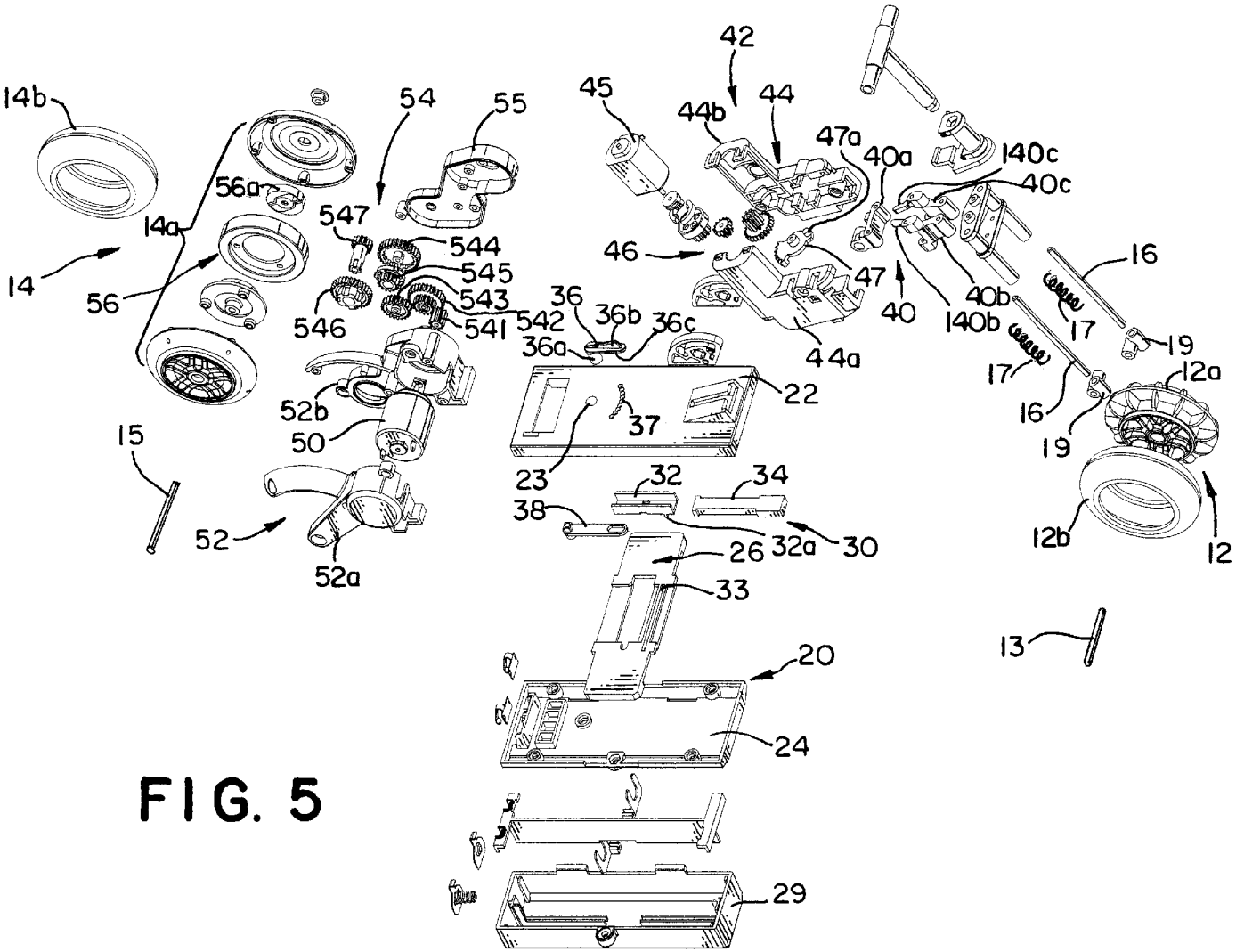
FIG. 5 is an exploded view of the two-wheeled scooter toy vehicle within which the present invention would be used.

Referring now to FIG. 5, the platform 20 is generally rectangular in shape and intended to resemble the platform of a scooter on which a rider would stand while operating the scooter. The platform 20 is made up of a top surface 22, a bottom surface 24, a skid plate 26 and a battery cover 29. The bottom surface 24 is engaged with the top surface 22, creating a cavity 28 therebetween (in FIG. 3). The skid plate 26 is sandwiched between the bottom surface 24 and the top surface 22, such that the skid plate 26 is held partially within the cavity 28, extending outwardly from both the left and right sides of the top and bottom surfaces 22, 24. The skid plate 26 allows the vehicle 10 to make turns and stop without the first and the second wheels 12, 14 becoming disengaged with the ground. The battery cover 29 is engaged with the bottom surface 24, within which a disposable or preferably rechargeable battery power supply (not depicted) is held.

The platform 20 has a front and a back end. The first wheel 12 is rotatably supported from the platform 20 proximal the front end. The first wheel 12 includes a first wheel body or hub 12*a* partially covered by a first wheel tire 12*b*. Preferably, the first wheel tire 12*b* is made of an elastomeric material, such as rubber, to enhance tire gripping. The first wheel 12 is freely rotatable about a first axle 13. The first wheel 12 is mounted within the legs of a fork 11 of a steering mechanism, indicated generally at 40. The steering mechanism has a base member 40*a*, a first link 40*b*, and a second link 40*c*. The first and second links 40*b*, 40*c* are pivotally engaged at both of their opposing first and second ends, their first ends pivotally engaged with the base member 40*a* and their second ends pivotally engaged with the fork 11. The base member 40*a* is rigidly engaged with an actuator housing. The actuator housing 44 is formed by half shells 44*a*, 44*b* and is rigidly engaged with the front of the top surface 22 of the platform 20. The base member 40*a*, the first and second links 40*b*, 40*c* and the fork 11 create a four-bar linkage that causes the fork 11 to be swept across an arc in front of the vehicle 10 when the first and second arms 40*b*, 40*c* are pivoted, thereby causing the first wheel 12 to caster about the arc in front of the vehicle 10 so as to turn the vehicle 10. An actuator 42 is maintained in the actuator housing 44 and includes a motor 45 operably coupled to the steering mechanism 40 through a steering gear train, indicated generally at 46. The last element 47 of the gear train 46 is pivotally mounted in housing 44 and includes a pin 47a positioned between fingers 140*b*, 140*c* extending from links 40*b*, 40*c*. Rotational motion produced by the actuator 42 through element 47 causes the steering mechanism 40 to pivot in the way described above, thereby pivoting the first wheel 12 and causing the vehicle 10 to turn. Although the steering mechanism 40 of the present invention is a four-bar linkage, it is within the spirit and scope of the invention for the steering mechanism 40 to be another pivotable mechanism, such as a simple hinge.

Upper ends of rods 16 are rigidly maintained within the fork 11, with a portion of the rods 16 exposed, protruding from the bottom of the fork 11. Connectors 19 are slideably engaged along the protruding ends of the rods 16. The first axle 13 rotatably supporting the front wheel 12 is supported between the connectors 19, allowing the first wheel 12 to rotate therebetween. Springs 17 are located along the rods 16 between the top of the connectors 19 and the bottom the fork 11, biasing the connectors 19 and consequently the first wheel 12, downwardly along the rods 16. The springs 17 act as shock absorbers, allowing the first wheel 12 to slide upwardly along the rods 16 when bumps are encountered by the vehicle 10, but causing the first wheel 12 to be biased downwardly along the rods 16 so that it is maintained proximate the lower ends of the rods 16 when the vehicle 10 is stationary or being operated along a smooth surface.

The second wheel 14 is rotatably supported from the platform 20 proximal the back end by a motor housing indicated generally at 52 and formed by shell halves 52*a*, 52*b* which are rigidly engaged with the back end of the platform 20. The first wheel 12 and the second wheel 14 are oriented such that they are generally in line along a center vertical plane of the platform 20 and parallel to and in line with each other and the central vertical plane. The second wheel 14 is made up of a second wheel body or hub 14*a* mounting a second tire 14*b*. Preferably, the second tire 14*b* preferably is made of an elastomeric material, such as rubber, to enhance tire gripping. Maintained within the second wheel body 14*a* is a flywheel mechanism, indicated generally at 56. A propulsion motor 50 is operably associated with the second wheel 14 to rotate the second wheel 14 and propel the vehicle. More particularly, motor 50 is maintained within the motor housing 52 and produces rotational motion that is transmitted to the second wheel 14 through a propulsion gear train 54 held within a gear train housing 55.

The propulsion gear train consists of a pinion 541, a first compound gear 542, a spur gear 543, a first clutch gear 544, a second clutch gear 545, a second compound gear 546, and a third compound gear 546. The pinion 541 is directly engaged with the motor 50. The pinion 541 engages with the larger gear of the first compound gear 542. The smaller gear of the first compound gear 542 engages with the spur gear 543 which, in turn, engages with the first clutch gear 544. The first clutch gear 544 engages with the second clutch gear 545 in such a way to allow rotation of the two in the same direction under normal conditions. But, if the second clutch gear 545 should bind for some reason (i.e. the second wheel 14 gets stuck), the interaction between the first and second clutch gears 544, 545 allows the first clutch gear 544 to continue rotating while the second clutch gear 545 stands still. This feature protects the motor 50 from damage if the second wheel 14 should get stuck while the motor 50 is still being powered to rotate. The second clutch gear then engages with the larger gear of the second compound gear 546. The smaller gear of the second compound gear 546 directly engages the second wheel body 14*a*, such that rotation of the second compound gear 546 causes rotation of the second wheel 14. The first clutch gear 544 also engages the third compound gear 547. The third compound gear 547 is rotatably maintained within the center of the second compound gear 546, such that both are rotatable about the same axis. The smaller gear of the third compound gear 547 directly engages with and rotates a clutch 56*a*, maintained within the second wheel body 14*a*. Due to the differing gear ratios between the two pairs of gears, the first pair being the second clutch gear 545 and the second compound gear 546 and the second pair being the first clutch gear 544 and the third compound gear 547, the clutch 56*a* is rotated at a higher rotational speed than the second wheel 14.

Operation of the propulsion motor 50 causes the second wheel 14 to rotate about a second axle 15 to propel the vehicle 10. Operation of the propulsion motor 50 also causes the fly wheel mechanism 56 to rotate with selective engagement of the clutch 56*a*. Clutch 56*a* has a pair of almost semicircular cantilever arms which spread apart when rotated and engage an inner hub surface of flywheel 56. Rotation of the fly wheel mechanism 56 increases the stability of the vehicle 10, thereby increasing control and maneuverability.

The vehicle 10 has an on-board control unit 90 (in phantom FIG. 1) that is conventional and maintained within the vehicle 10. The on-board control unit 90 includes a radio receiver circuit and an associated motor control circuit and is in electrical communication with the battery power supply as well as both the motor 45 of actuator 42 and the propulsion motor 50. The on-board control unit 90 is configured to receive and process control signals transmitted from a remote control unit 70 (FIG. 2) spaced from the vehicle 10 to remotely control movement of the vehicle 10.

Figure 3:
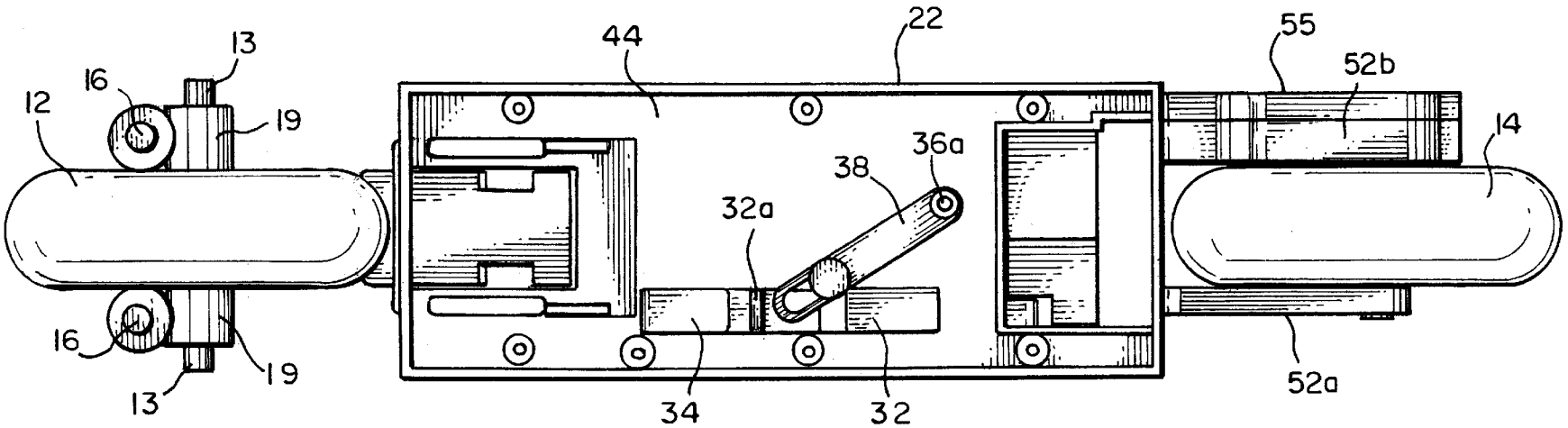
FIG. 3 is a view of the bottom of the vehicle in FIG. 1, partially disassembled to reveal the present invention.
Figure 4:
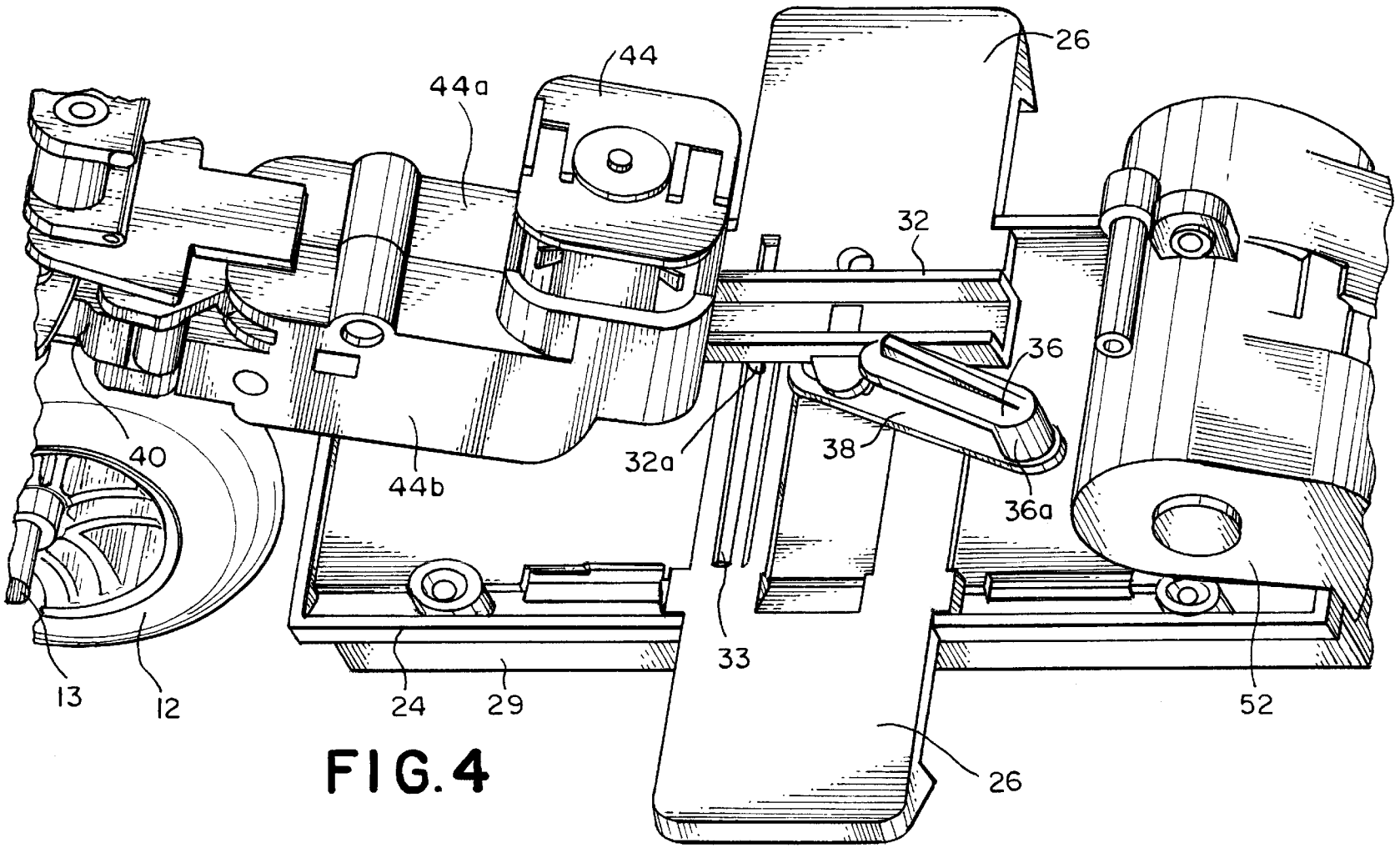
FIG. 4 is a view as seen from the top left side of the present invention within the vehicle in FIG. 1.

The trim adjustment mechanism 30 is mounted to the platform so as to adjust side-to-side to balance the vehicle 10 and thereby enhance the stability 10. Referring now to FIGS. 3–5, the trim adjustment mechanism 30 includes a weight holder 32, a weight member 34, and adjustment lever 36 and a connecting arm 38. The weight holder 32 is slideably mounted to the platform 20 for side-to-side movement in a direction at least transverse to the center vertical plane of the platform 20. The weight holder 32 has a protrusion 32*a* (FIG. 3) that is slideably maintained within a slot 33 (FIG. 4) in the skid plate 26 on which the weight holder 32 slides. The interaction between the protrusion 32*a* and the slot 33 limits the motion of the weight holder 32 and constrains its motion to purely side-to-side motion. The weight member 34 is engaged with the weight holder 32 for slideable side-to-side movement with the weight holder 32 on the platform 20 to balance the vehicle 10. The weight member 34 is made of a heavy material such as metal. The weight member is elongated and is mounted with its elongated direction parallel to the center vertical plane. The weight member 34 is frictionally held by the weight holder 32. However, it is within the spirit and scope of the invention to attach the weight member 34 to the weight holder 32 through other means, such as adhesives or fastening members.

The adjustment lever 36 is L-shaped and is accessible to the user at the platform top surface 22 beneath a toy FIG. 18. The adjustment lever 36 has a first end 36*a* pivotally mounted to the platform 20 and operably coupled with the weight holder 32. A second end 36*b* of the adjustment lever 36 is proximate and parallel to the top surface 22 and the first end 36*a* of the adjustment lever 36 is perpendicular to the top surface 22, extending through the top surface 22 at an aperture 23. The first end 36*a* of the adjustment lever 36 engages with the connecting arm 38 which is in turn pivotally engaged with the weight holder 32. The adjustment lever 36 is pivotable about the first end 36*a*. The adjustment lever is non-pivotally engaged with the connecting arm 38 which is operably preferably pivotally engaged with the weight holder 32. Pivoting the adjustment lever 36 causes the connecting arm 38 to pivot as well, which, in turn, causes the weight holder 32 and weight member 34 to slide side-to-side.

The adjustment lever 36, and, consequently, the weight member 34 are held at the desired position by interaction between an adjustment lever tab 36*c* and one of a plurality of depressions 37 in an arc centered at the aperture 23 on the top of the platform top surface 22. The adjustment lever tab 36*c* is preferably a small hemispherical protrusion on the underside of the second end 36*b* of the adjustment lever 36. The tab 36*c* is shaped to fit within any one of the plurality of depressions 37. The tab 36*c* fits within the depression 37 closest to the desired weight setting, thereby preventing unwanted random motion of the trim adjustment mechanism 30 while the vehicle 10 is in motion.

Figure 2:
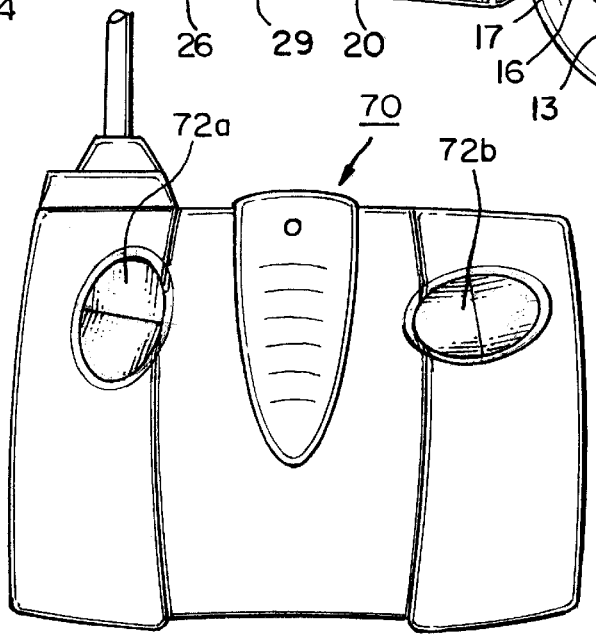
FIG. 2 is a remote controller for the toy vehicle of FIG. 1.

Referring to FIG. 2, the vehicle 10 is to be used in combination with the remote control unit 70 which is configured to direct movement of the vehicle 10. The remote control unit 70 is conventional and has a pair of manual controls 72 preferably toggles, and radio transmission circuitry (not depicted). A first manual control 72*a* activates the propulsion motor 50, which causes rotation of the second wheel 14 and effects forward motion of the vehicle 10. A second manual control 72*b* activates the actuator 42, which causes the steering mechanism 40, along with the first wheel 12, to pivot, thereby effecting a turn of the vehicle 10.

The vehicle 10 further includes toy FIG. 18, which is fixedly connected to the top surface 22 of the platform 20. The FIG. 18 is intended to simulate a rider on the vehicle 10. Although predominately aesthetic, the FIG. 18 can also be used to hide individual components from view of the user, such as the on-board control unit and the antenna (not depicted). The figure's right/forward foot covers the upper end of steering actuator housing 42. The FIG. 18 can also be sculpted in such a way to better balance the vehicle 10. Although the vehicle 10 of the present invention includes a FIG. 18, it is within the spirit and scope of the invention that the vehicle 10 could be used without a FIG. 18.

In operation, the trim adjustment mechanism 30 of the vehicle 10 allows the user to set the position of the weight member 34 within the cavity 28 in order to change the handling characteristics of the vehicle 10. Rotation of the adjustment lever 36 by the user causes the weight member 34 to slide side-to-side in the cavity 28. The weight member 34 is sufficiently heavy to affect the handling characteristics of the vehicle 10 by altering the balance of the vehicle 10. Primarily, the trim adjustment mechanism 30 is meant to be used to offset the additional weight on the left side of the vehicle 10 caused by the placement of the propulsion motor 50 and the propulsion gear train 54. The increased weight on the left side of the vehicle 10 causes the vehicle 10 to exhibit a large, sweeping left turn while the user attempts to drive the vehicle 10 along a straight path. By turning the adjustment lever 36 to the right side, thereby moving the weight member 34 to the right side of the cavity 28, the user can effectively balance the additional weight of the propulsion motor 50 and the propulsion gear train 54 on the left side of the vehicle 10, allowing the vehicle 10 to be operated free of the large, sweeping left turn. Alternatively, the trim adjustment mechanism 30 may be set by the user to either side to effectuate a large sweeping turn in that direction, if so desired. Also, the trim adjustment mechanism 30 may be used to balance the weight of the vehicle 10 if the user places additional objects on the vehicle 10 during use and to compensate for production, molding imperfections and varying assembly tolerances.

Additional mechanical features of the vehicle 10 are described in U.S. Pat. No. 6,095,891, which is incorporated by reference herein.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A wheeled toy vehicle configured to be maneuvered on a surface, the vehicle comprising:

a platform having a front end and a back end;

a first wheel rotatably supported from the platform proximal the front end;

a second wheel rotatably supported from the platform proximal the back end, the first wheel and the second wheel being generally in line along a center vertical plane of the platform and parallel to and in line with each other and the center vertical plane; and a trim adjustment mechanism mounted to the platform so as to adjust side-to-side to balance the vehicle and thereby enhance the stability of the vehicle wherein the trim adjustment mechanism further comprises:

a weight holder slideably mounted to the platform for side-to-side movement in a direction at least transverse to the center vertical plane; and a weight member engaged with the weight holder for slidable side-to-side movement with the weight holder on the platform to balance the vehicle.

2. The toy vehicle according to claim 1 further comprising a propulsion motor operatively associated with the second wheel to rotate the second wheel to propel the vehicle.

3. The toy vehicle according to claim 2 further comprising:

a steering mechanism pivotally mounted to the platform proximal the front end, the first wheel being rotatably supported from the platform on the steering mechanism; and an actuator operatively coupled with the steering mechanism to pivot the steering mechanism and first wheel with respect to the platform to turn the vehicle.

4. The toy vehicle according to claim 3 further comprising an on-board control unit operably coupled with the actuator and propulsion motor and configured to receive and process control signals transmitted from a remote source spaced from the vehicle to remotely control movement of the vehicle.

5. The toy vehicle according to claim 1 wherein the trim adjustment mechanism further comprises an adjustment lever having a first end operably coupled with the weight holder, the adjustment lever being pivotable about the first end such that pivotal movement of the adjustment lever about the first end causes sliding side-to-side movement of the weight holder and weight member.

6. The toy vehicle according to claim 1 wherein the trim adjustment mechanism further comprises an adjustment lever having a first end pivotally mounted to the platform and a connecting arm operably coupled with the first end of the lever arm and with the weight holder.

7. The toy vehicle according to claim 1 in combination with a remote control unit operated remotely from the vehicle and configured to direct movement of the toy vehicle.

8. The toy vehicle according to claim 1 further comprising a toy figure connected to the top of the platform.

9. In a toy vehicle configured for movement in at least a forward direction and including a chassis and a central longitudinal vertical plane through the chassis, a trim adjustment mechanism to balance the vehicle, the trim mechanism comprising:

a weight member mounted for movement in the vehicle to either side of the center longitudinal vertical plane; and an adjustment lever having a first end operably coupled with the weight member so as to enable manual movement of the weight member to either side of the center longitudinal vertical plane;

whereby a user can effectuate side-to-side movement of the weight member within the vehicle with the adjustment lever in order to balance the vehicle to enhance stability of the vehicle at least during forward movement.

10. The trim adjustment mechanism according to claim 9 further comprising a weight holder slideably supported by the chassis to move transversely to the central vertical plane, the weight member being engaged with the weight holder for slidable movement with the weight holder, and the weight holder being operatively coupled with the adjustment lever to move the weight holder and weight member side to side on the vehicle.

11. The trim adjustment mechanism according to claim 10 wherein the adjustment lever is pivotable about the first end such that rotation of the adjustment lever causes side-to-side movement of the weight member.

12. The trim adjustment mechanism according to claim 9 in combination with the vehicle wherein the vehicle further comprises first and second wheels supported in line with one another and the central longitudinal vertical plane and a propulsion motor operatively associated with at least the second wheel to rotate the second wheel to propel the vehicle.

13. The trim adjustment mechanism according to claim 9 in combination with the vehicle wherein the vehicle further comprises:

a first wheel rotatably engaged with a fork member;

a steering mechanism pivotally mounting the fork member to the platform proximal the front end; and an actuator operatively coupled with the steering mechanism, whereby the actuator pivots the steering mechanism pivot causing the fork member and the first wheel to pivot,with respect to the platform to turn the vehicle.

14. The trim adjustment mechanism according to claim 9 in combination with the vehicle wherein the vehicle further comprises:

first and second wheels supported from the chassis in line with one another and the central longitudinal vertical plane;

a propulsion motor operatively associated with the second wheel to rotate the second wheel to propel the vehicle;

a steering mechanism pivotally mounted to the chassis proximal the front end; and an actuator operatively coupled with the steering mechanism to pivot the steering mechanism and front wheel with respect to the chassis to turn the vehicle.

15. The trim adjustment mechanism according to claim 9 in combination with the toy vehicle wherein the toy vehicle further comprises:

a propulsion system supported from the chassis so as to propel the toy vehicle in at least a forward direction.

16. The combination of claim 15 wherein the toy vehicle further comprises a steering mechanism supported from the chassis so as to steer the toy vehicle while moving in a forward direction.

* * * * *